US007396258B2

(12) United States Patent
Zhang

(10) Patent No.: US 7,396,258 B2
(45) Date of Patent: Jul. 8, 2008

(54) CABLE CONNECTOR

(75) Inventor: Ming Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/900,883

(22) Filed: Sep. 13, 2007

(65) Prior Publication Data

US 2008/0064267 A1 Mar. 13, 2008

(51) Int. Cl.
*H01R 24/00* (2006.01)

(52) U.S. Cl. ..... 439/660; 439/579; 439/857

(58) Field of Classification Search ..... 439/660, 439/579, 857

See application file for complete search history.

(56) References Cited

U.S. PATENT DOCUMENTS 3,248,686 A * 4/1966 Ruehlemann ..... 439/748
3,559,154 A * 1/1971 Akin ..... 439/750
4,743,208 A * 5/1988 Weisenburger ..... 439/398
5,267,881 A * 12/1993 Matuzaki ..... 439/660
5,435,757 A * 7/1995 Fedder et al. ..... 439/686
5,957,734 A * 9/1999 Gladd et al. ..... 439/857
6,527,592 B2 * 3/2003 Mochizuki et al. ..... 439/660
6,979,237 B2 12/2005 Xiang et al.
7,059,906 B2 6/2006 Kato et al.
2007/0117467 A1 * 5/2007 van der Steen ..... 439/660

* cited by examiner

*Primary Examiner*—Tho D Ta
(74) *Attorney, Agent, or Firm*—Wei Te Chung

(57) ABSTRACT

A cable connector comprises a housing formed with a main body and a mating portion forwardly extending from the main body and a plurality of contacts. The main body and the mating portion are formed with a plurality of ribs, every two adjacent ribs defining a slot. The contacts received in the slots, the contact has at least one signal contacts, the signal contact is formed with a mounting portion located in the main body and two parallel contacting arms extending forwardly from a front end of the mounting portion and located in the mating portion.

13 Claims, 4 Drawing Sheets

CABLE CONNECTOR

BACKGROUND OF THE INVENTION

1. Field of the Invention

The present invention relates to a cable connector for electrically connecting cables to a print circuit board.

2. Description of Related Art

Following development of electronic and communication technology, more and more different connectors are widely used for connecting electronic equipments, such as a cable connector, which is used for connecting cables to a print circuit board and builds signal transmission path between the cable and the print circuit board.

A cable connector for connecting cables to a print circuit board include a first connector and a second connector, the first connector comprises an insulating housing with a mating portion, a plurality of piece-like contacts received in the insulating housing and a shell covering the insulating housing. Each contact has a contact portion arranged in an upper surface of the mating portion for connecting with the second connector, and a mounting portion in rear of the contacting portion for soldering with the cables. The second connector has a second housing defining a receiving room for receiving the mating portion and a plurality of terminals arranged on sides of the receiving room. When the first connector engages with the second connector, the first contacts electrically contact with the terminals.

However, the contacts of the first connector includes a plurality of signal contacts and the width of the signal contact is narrow, so the signal contacts can not meet the requirement for high electrical current transmission. Furthermore, it is not easily to solder the cables to the mounting portions of the signal contacts, and the contacting between the contacting portion of the contact and a corresponding terminal is not reliably for the narrow width of the contact.

Hence, an improved cable connector is required to overcome the disadvantages of the prior art.

SUMMARY OF THE INVENTION

An object of the present invention is to provide a cable connector, which allows a high electrical current to pass through.

Accordingly, to achieve above-mentioned object, a cable connector comprises a housing and a plurality of contacts, the housing is formed with a main body and a mating portion forwardly extending from the main body which are provided with a plurality of ribs, and every two adjacent ribs defines a slot. The contacts are received in the slots and have at least one signal contacts, the signal contact has a mounting portion located in the main body and two parallel contacting arms extending forwardly from a front end of the mounting portion and located in the mating portion.

Other objects, advantages and novel features of the present invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
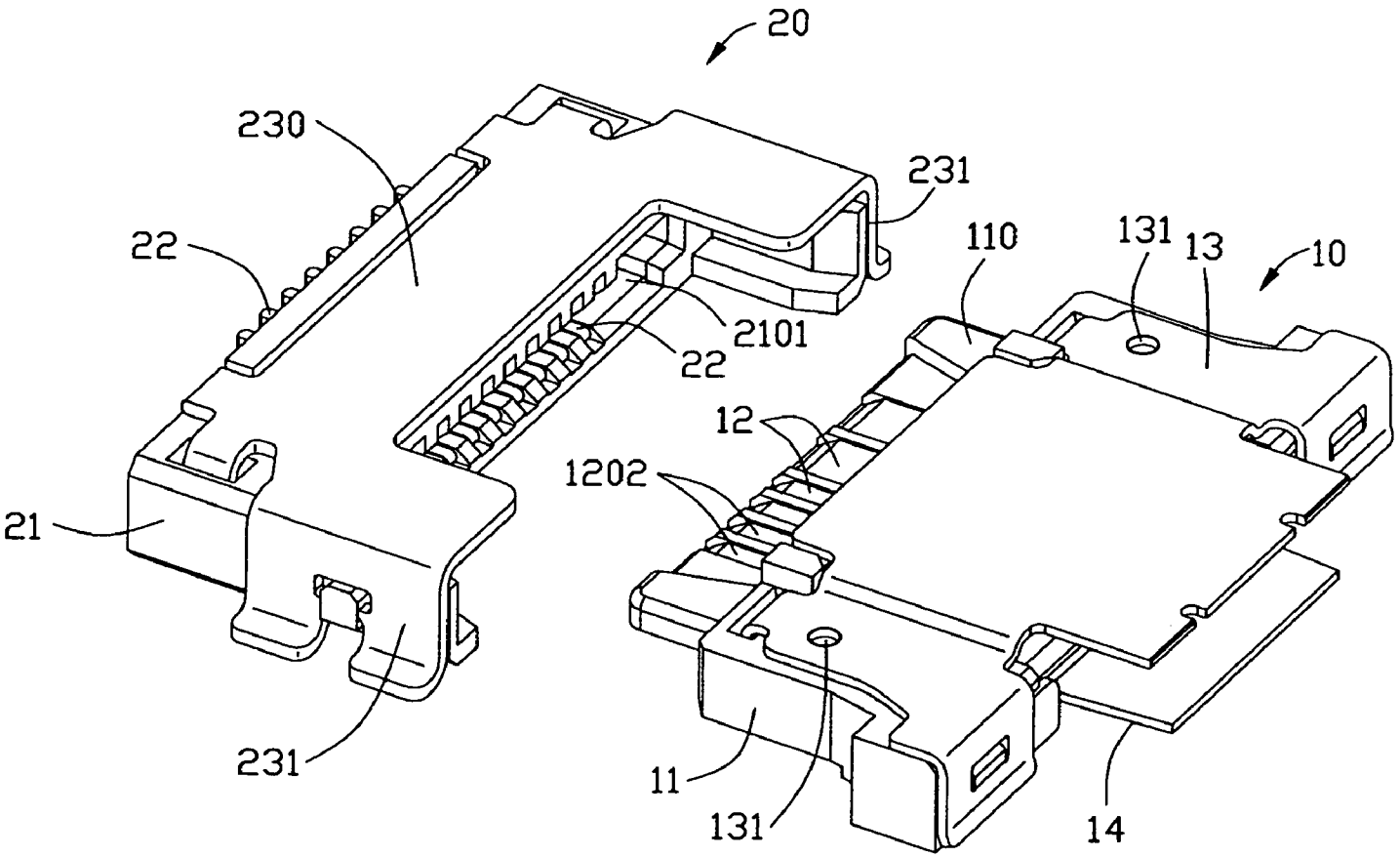
FIG. 1 is a perspective view of a first connector and a second connector of a cable connector assembly of the present invention.

Referring to FIG. 1, the cable connector assembly in accordance with the present invention comprises a first connector 10 for connecting cables (not shown) and a second connector 20 for mounting to a print circuit board (not shown). The second connector 20 electrically contacts with the first connector 10 to electrically connect the cable to the print circuit board.

Figure 2:
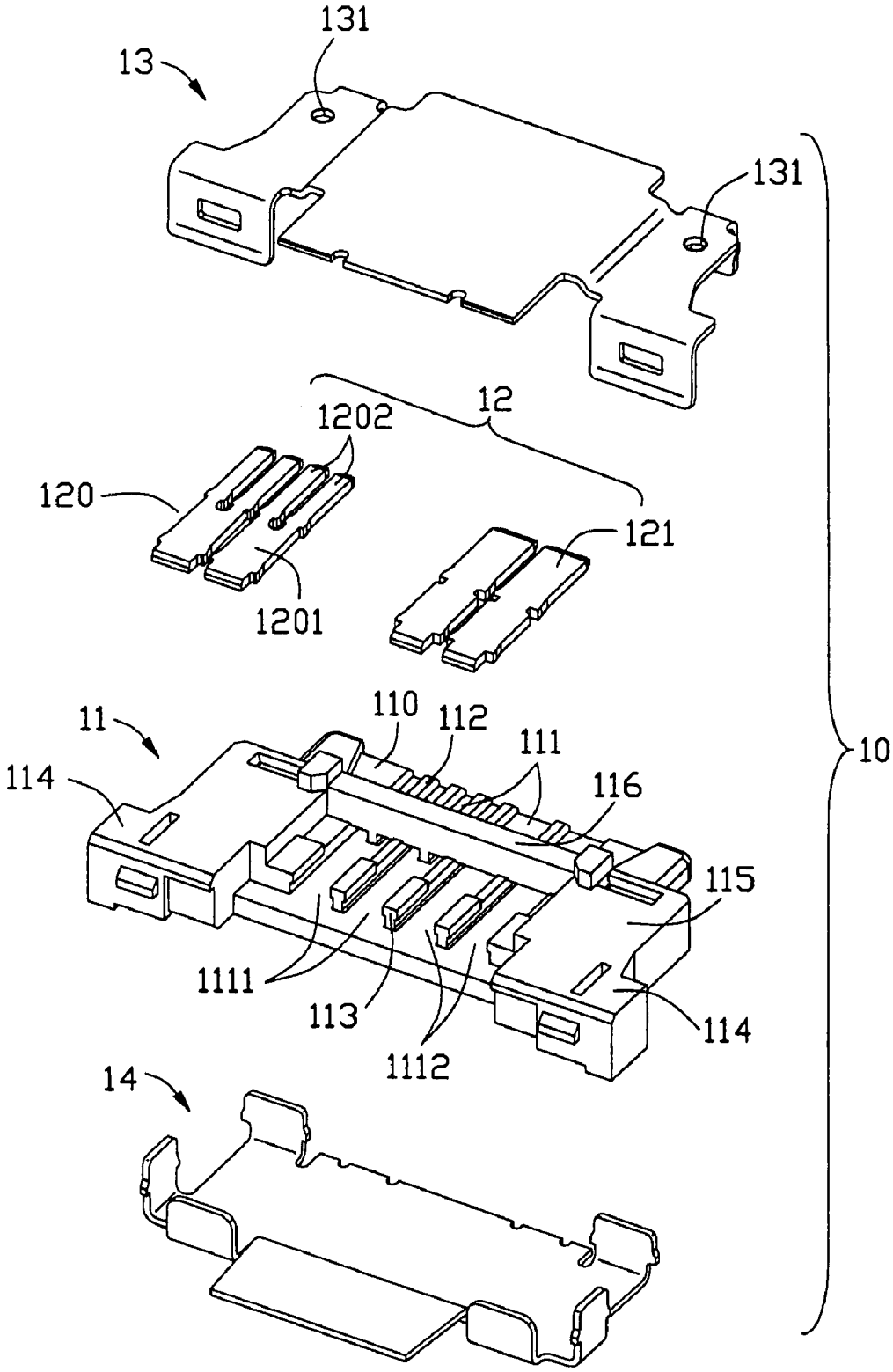
FIG. 2 is an exposed, perspective view of the first connector.

Referring to FIG. 2, the first connector 10 comprises a first housing 11, a plurality of first contacts 12 including two signal contacts 120 and two power contacts 121, and a shell covering the first housing 11. The first housing 11 comprises a main body 115, two ears 114 on lateral sides of a rear end of the main body 115 and a mating portion 110 extending forwardly from a center portion of a font end of the main body 115. The first housing 10 define a recess (not labeled) recessed from a top surface of the main body 115, and is formed with a bridge 116 separating the recess and the mating portion 110. The first housing 11 is formed with a plurality of ribs 112 upwardly protruding from the recess of the main body 115 and a top surface of the mating portion 110, and defines a plurality of slots 111 formed by every two adjacent ribs 112. The slots 111 include a plurality of first slots 1111 for receiving the signal contacts 120 on the right side, and a plurality of second slots 1112 for receiving the power contacts 121 on the left side. All the slots 111 defined on the mating potion 110 are aligned and communicated with the slots 111 defined on the main body 115 through the bridge 116 for the first contacts 12 inserting into from back to front.

Referring to FIG. 1, each first contact 12 is approximate in strip-shaped and has a front part and a rear part. The rear part of the signal contact 120 is a mounting portion 1201, and a gap (not labeled) extends rearward from a center of front edge of the front part till the mounting portion 1201 to form two parallel contacting arms 1202. The power and signal contacts 120, 121 horizontally insert into the first housing 11 along a back-to-front direction, the rear part of the power contacts 121 and the mounting portion 1201 of the signal contacts 121 are seated in the slots 111 on the main body 115 for connecting the cables (not shown), the front part of the power contacts 121 and the contacting arms 1202 of the signal contacts 121 are seated in the slots 111 on the mating portion 110 for contacting with the second connector 20. Wherein two of the ribs 112 are received in the gaps (not labeled) to separate the contacting arms 1202 of each signal contact 120. Furthermore, each slot 112 formed on the main body 115 has a retaining portion 113 on a rear end thereof for retaining the first contacts 12.

The shell includes a top plate 13 and a bottom plate 14, respectively assembling to a top surface and a bottom surface of the main body 115 of the first housing 11 to cover the first housing 11. The top plate 13 is formed with a pair of holes 131 on two lateral sides thereof.

Figure 3:
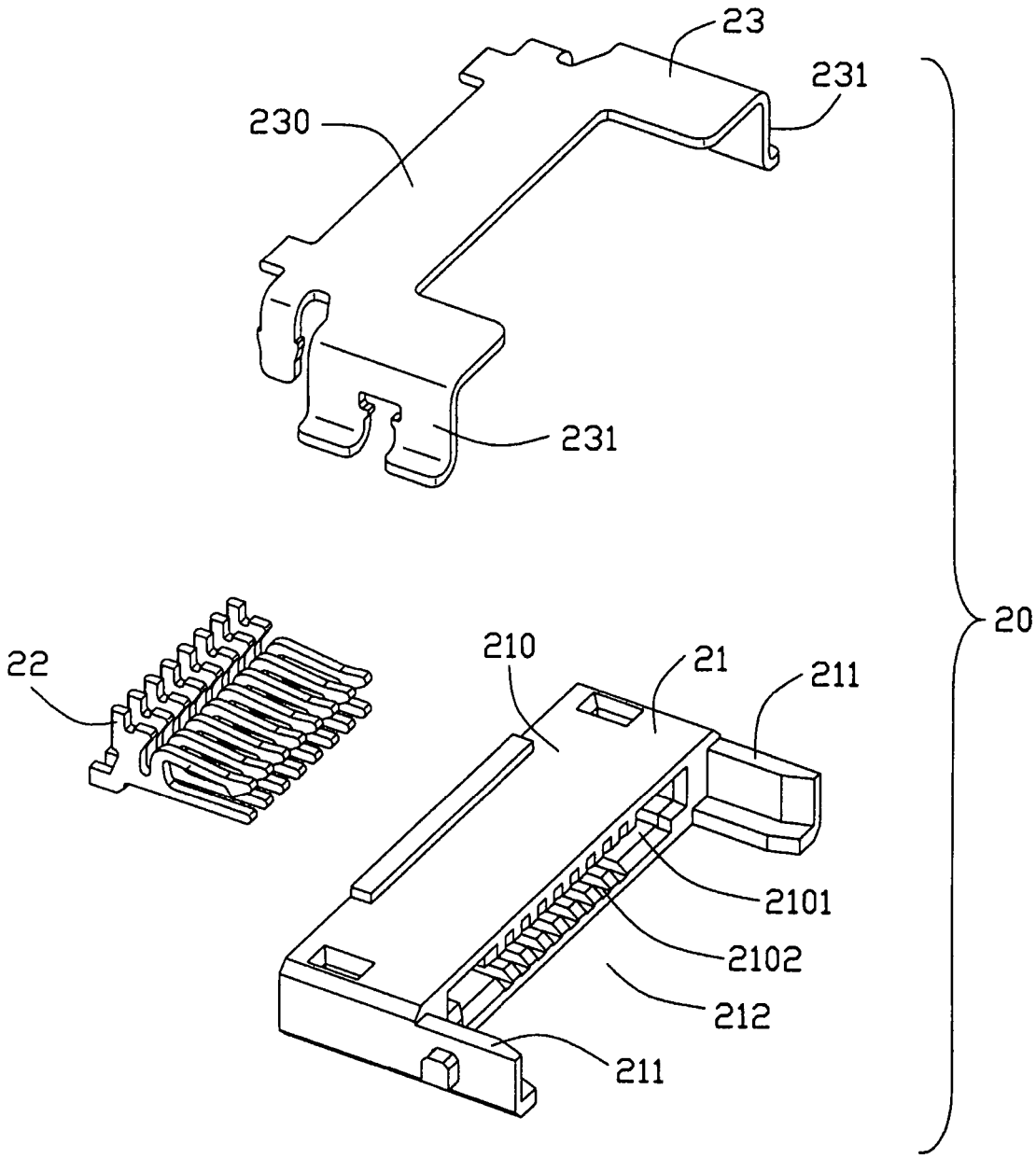
FIG. 3 is an exposed, perspective view of the second connector.
Figure 4:
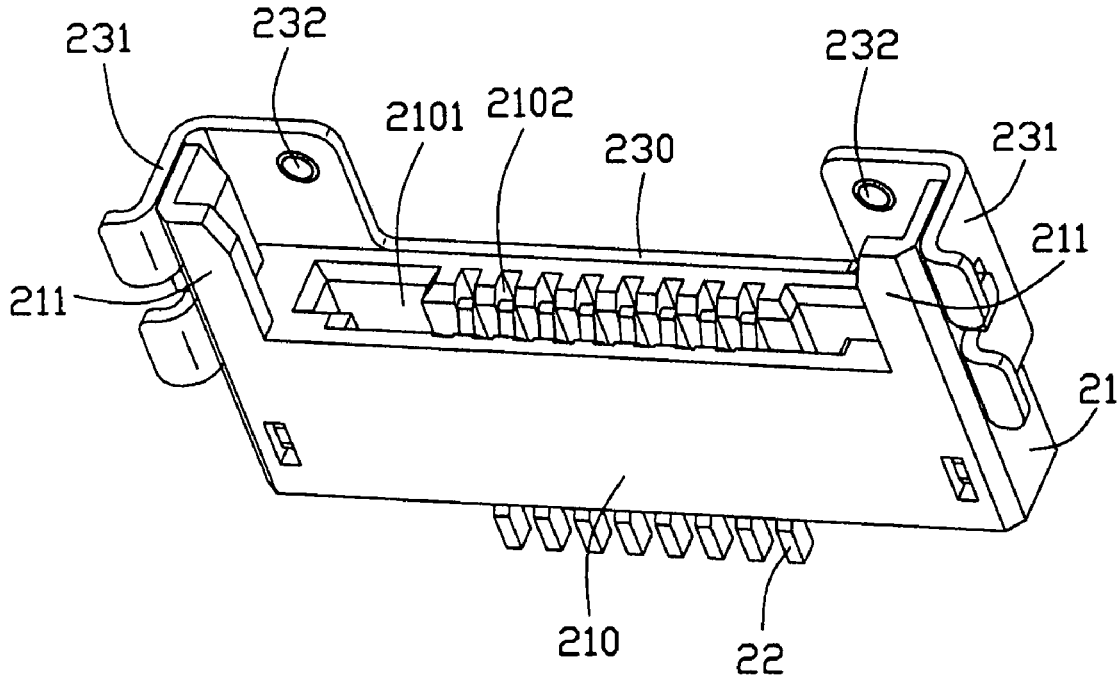
FIG. 4 is another perspective view of the first connector.

Referring to FIGS. 3-4, the second connector 20 comprises a second housing 21, a plurality of second contacts 22 received in the second housing 21 and a cover 23 assembled to the second housing 21. The second housing 21 has a base 210 defining a mating surface (not labeled) and two arms 211 extending from two lateral sides of base 210 and defining a space 212 for the first connector together with the base 210.

The second housing 21 defines a receiving space 2101 recessed from a center part of the mating surface and a plurality of channels 2102 on upper and bottom inner sidewalls of the receiving space 2101. Each second contacts 22 has a U-shaped contact portion (not labeled), whose two legs respectively received in two channels 2102 which are opposed in a vertical direction.

The cover 23 has a horizontal plate 230 and two sidewalls 231 each extending from a lateral side of the horizontal plate 230 with a soldering pad (not labeled) for soldering to the print circuit board. When the cover 23 assembles to the second housing 21, the horizontal plate 230 forms a pair of guiding channel (not labeled) together with the arms 211 of the second housing 21, and two projecting portion 232 is formed in an inner side of the horizontal plate 230 and exposed in the guiding channel (not labeled).

Referring to FIG. 1 and FIG. 4, a front part of the first connector 10 inserts into the space 212 of the second connector 20 along the guiding channel till the mating portion 110 is completely received in the receiving space 2101. The U-shaped contacting portions of the second contacts 22 clamp the mating portion 110 and electrically contact with the first contacts 12. The projecting portions 232 of the cover 23 respectively engage with the holes 131 on the top plate 13 to enhance an interference force between the first and the second connectors.

In fact, each contacting arm 1202 is approximately equal to a prior contact in width, so the signal contact 120 is twice as wide as the prior contact, And then the signal contacts 120 can allow high electrical current to pass through. The mounting portion 1201 of the signal 120 has a large soldering surface on which the cable can reliably mount. And each signal contact 120 has two contacting arms 1202 to ensure reliably electrical connecting with corresponding second contact 22, even only one contacting arms 1202 contacts with the second contacts 22.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A cable connector comprising:

a housing having a main body and a mating portion forwardly extending from the main body, the main body and the mating portion being formed with a plurality of ribs, every two adjacent ribs defining a slot, and;

a plurality of contacts received in the slots and having at least one signal contacts, the signal contact being formed with a mounting portion and two parallel contacting arms extending horizontally and forwardly from a front end of the mounting portion, the mounting portion received in a slot on the main body, the two contacting arms respectively received in two slots on the mating portion which are separated by the rib and communicating with the corresponding slot received the mounting portion;

wherein the signal contact defines a gap extending rearward from a center of front edge thereof till the mounting portion to form the two parallel contacting arms;

wherein the main body has a recess recessed from a top surface thereof and a bridge disposed between the recess and the mating portion, the slots formed on the main body are formed in the recess, and communicate with the slots formed on the mating portion through the bridge.

2. The cable connector as described in claim 1, wherein the contacts have at least one power contact, the power contact has a front part disposed in the mating portion and a rear part disposed in the main body.

3. The cable connector as described in claim 1, wherein at least one of the ribs is received in the gap to separate the two contacting arms of each signal contact.

4. A cable connector assembly comprising:

a first connector comprising a first housing defining a plurality of slots, a plurality of first contacts received in the slots, the first contact having at least one signal contact, the signal contact being provided with a mounting portion and two parallel contacting arms extending forwardly from a front end of the mounting portion;

a second connector comprising a second housing defining a receiving space for receiving the mating portion of the first housing and a plurality of second contacts for electrically connecting with the first contacts;

wherein the first housing is formed with a main body and a mating portion forwardly extending from the main body which are formed with a plurality of ribs, the slots of the first housing are defined by every two adjacent ribs, the mounting portion of the signal contact is located in the main body and the two parallel contacting arms are located in the mating portion;

wherein the signal contact defines a gap extending rearward from a center of front edge thereof till the mounting portion to form the two parallel contacting arms;

wherein the main body has a recess recessed from a top surface thereof and a bridge disposed between the recess and the mating portion, the slots of the main body are formed in the recess and communicate with the slots formed on the mating portion through the bridge.

5. The cable connector assembly as described in claim 4 wherein the contacts have at least one power contact, the power contact has a front part disposed in the mating portion and a rear part disposed in the main body.

6. The cable connector assembly as described in claim 4, wherein at least one of the ribs is received in the gap to separate the two contacting arms of each signal contact.

7. The cable connector assembly as described in claim 6, wherein the first connector further comprises a shell composed of a top plate and a bottom plate respectively covering a top surface and a bottom surface of the first housing.

8. The cable connector assembly as described in claim 7, wherein the signal contact defines a gap extending rearward from a center of front edge thereof till the mounting portion to form the two parallel contacting arms.

9. An electrical connector assembly comprising:

a first connector including: a first insulative housing defining a plurality of rear slots and front slots respectively communicatively aligned with each other, some of said front slots each further equipped with a center rib to divide the corresponding front slot into two halves;

a plurality of first contacts essentially extending in a planar manner, and disposed in the first housing, some of said first contacts each defining a pair of split contacting arms straddling a corresponding rib and respectively received in the two halves of corresponding front slot, while a mounting portion of said first contact being seated in the corresponding rear slot; wherein the rear slots are essentially open upwardly but the front slots are hidden by a cross bar where the split contacting arms start.

10. The electrical connector assembly as claimed in claim 9, wherein the mounting portions are configured to be soldered to wires, respectively.

11. The electrical connector assembly as claimed in claim 9, wherein a metallic shell covers the first housing and said upward open contacting arms and mounting portions, and wherein a space between the cover and the mounting portions are reserved for wire extension.

12. The electrical connector assembly as claimed in claim 9, further including a second connector comprising a second insulative housing with a plurality of second contacts each is dimensioned to be compliant with one of split contact arms.

13. The electrical connector assembly as claimed in claim 12, wherein every two of said second contacts are coupled to one of said first contacts.

* * * * *